US011712616B1

(12) United States Patent
Triebwasser et al.

(10) Patent No.: US 11,712,616 B1
(45) Date of Patent: Aug. 1, 2023

(54) SPORTS HEAD AND NECK ORIENTATION RETAINER BLOCK AND TRAINING DEVICE

(71) Applicant: Sports Plus LLC, Commack, NY (US)

(72) Inventors: Michael Triebwasser, Bohemia, NY (US); Nancy Triebwasser, Commack, NY (US)

(73) Assignee: Sports Plus LLC, Commack, NY (US)

( * ) Notice: Subject to any disclaimer, the term of this patent is extended or adjusted under 35 U.S.C. 154(b) by 352 days.

(21) Appl. No.: 16/992,817

(22) Filed: Aug. 13, 2020

Related U.S. Application Data

(60) Provisional application No. 62/897,117, filed on Sep. 6, 2019.

(51) Int. Cl.
*A63B 71/12* (2006.01)
*A63B 71/10* (2006.01)
*A63B 102/24* (2015.01)

(52) U.S. Cl.
CPC ..... *A63B 71/1291* (2013.01); *A63B 71/10* (2013.01); *A63B 2102/24* (2015.10); *A63B 2243/0025* (2013.01); *A63B 2243/0037* (2013.01)

(58) Field of Classification Search
CPC ..... A63B 71/1291; A63B 2102/24; A63B 2243/0037
See application file for complete search history.

(56) References Cited

U.S. PATENT DOCUMENTS 2,774,601 A 12/1956 White
3,320,950 A * 5/1967 McElvenny ..... A61F 5/055 602/18
3,850,164 A * 11/1974 Hare ..... A61F 5/055 602/18
3,879,761 A 4/1975 Bothwell
4,219,193 A 8/1980 Newman
4,319,362 A 3/1982 Ettinger
4,617,691 A * 10/1986 Monti ..... A47C 7/383 5/636
6,058,517 A * 5/2000 Hartunian ..... A41D 13/0512 602/18
D439,342 S 3/2001 Selp, Jr.
6,219,865 B1 4/2001 Stokesbury
D469,541 S 1/2003 Cheatham
D519,639 S 4/2006 Follman
7,055,908 B1 * 6/2006 Williams ..... A47C 7/383 297/392
7,204,767 B2 * 4/2007 Roberts ..... A63B 69/3608 473/212
D644,331 S 8/2011 Sandhu
D662,557 S 6/2012 Nawracaj
(Continued)

*Primary Examiner* — Tajash D Patel
(74) *Attorney, Agent, or Firm* — Alfred M. Walker

(57) ABSTRACT

A head and neck orientation retainer block for training young or adult athletes for their sport while keeping their head up to provide a safer way to play, and also to enhance their skill and vision of the game. It can be worn during practices with the team and if one chooses, to practice at home. The retainer is a wedge block protrusion placed under the central forward chin of the child or adult player, to allow the player to have a wider freedom of side to side lateral movement, while the player's head is maintained horizontally for line of sight viewing purposes.

25 Claims, 6 Drawing Sheets

(56) References Cited

U.S. PATENT DOCUMENTS

| | | | | |
|---|---|---|---|---|
| 8,382,692 | B1 * | 2/2013 | Chao | A47C 7/383 602/17 |
| D719,662 | S | 12/2014 | Pope | |
| 9,215,903 | B2 | 12/2015 | Abbey et al. | |
| D766,449 | S | 9/2016 | Cappa | |
| D836,783 | S | 12/2018 | Hilliard | |
| D866,773 | S | 11/2019 | Hsu et al. | |
| D894,409 | S | 8/2020 | Yeip et al. | |
| D896,960 | S | 9/2020 | Marcus | |
| D897,546 | S | 9/2020 | Gowanlock et al. | |
| D900,327 | S | 10/2020 | Cleveland | |
| D910,858 | S | 2/2021 | Marton et al. | |
| D940,338 | S | 1/2022 | Alexandrescu et al. | |
| 2016/0303454 | A1 * | 10/2016 | Balent | A63B 71/0622 |
| 2018/0214327 | A1 * | 8/2018 | Stokesbary | A47C 7/383 |
| 2022/0202116 | A1 * | 6/2022 | Earls | A41D 13/0512 |

* cited by examiner

Fig. 6
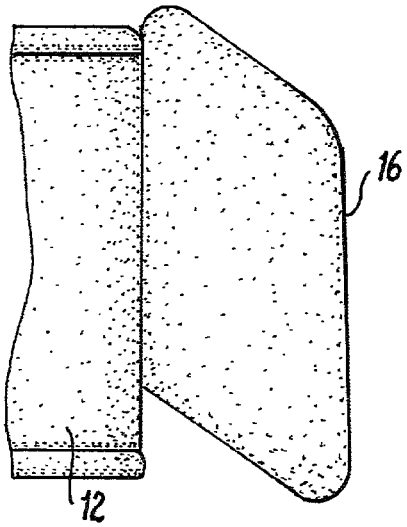
Fig. 7
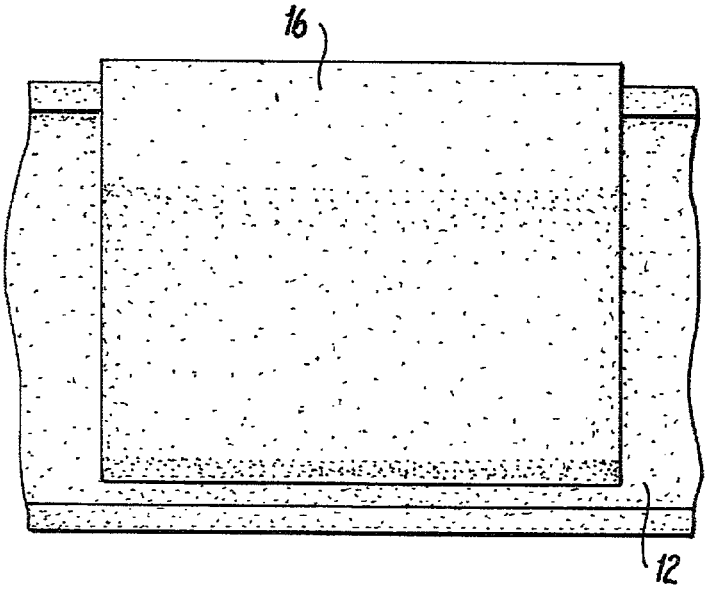
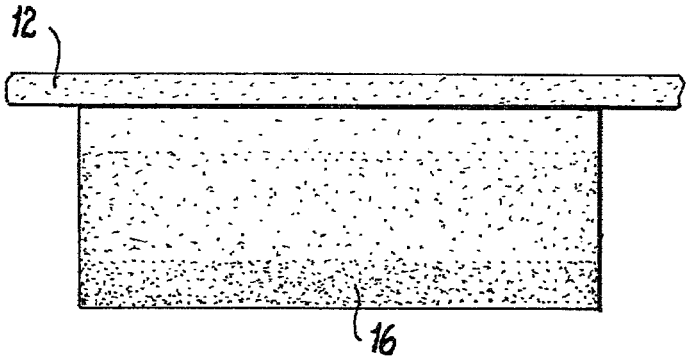
Fig. 8

SPORTS HEAD AND NECK ORIENTATION RETAINER BLOCK AND TRAINING DEVICE

RELATED APPLICATIONS

This application claims benefit under 35 USC § 119 (e) of provisional application number Appl. No.: 62/897,117, filed on Sep. 6, 2019. The '117 application is incorporated by reference herein.

FIELD OF THE INVENTION

The present invention relates to devices for orientating the eyes and head of the sports player horizontally for forward and lateral views, so that the player learns to locate the playing piece, such as an ice hockey puck, a roller hockey puck or ball, a field hockey ball, a basketball or a soccer ball by manual or foot feeling without direct viewing thereof.

BACKGROUND OF THE INVENTION

Various prior art neck supports are provided to substantiality immobilize the head and neck of a player in dangerous contact sports with helmets, such as football and racing car driving, as disclosed in U.S. Pat. No. 4,219,193 of Newman, U.S. Pat. No. 4,319,362 of Ettinger, U.S. Pat. No. 9,215,903 B2 of Abbey and Davis, and U.S. Pat. No. 3,879,761 of Bothwell.

Also, under the chin supports generally extend under most of the entire jaw of the user, from ear to ear, thereby reducing the user's lateral views and head movements. For example, these "chin supports" are wide jaw supports, so that implicitly they would tend to limit lateral side to side movement of the user's head, ostensibly to immobilize the user's head in general in a hair dressing salon (as in U.S. Pat. No. 6,219,865 B1 of Stokesbary) or to limit head movement during a golf swing (as in U.S. Pat. No. 2,774,601 of White).

These prior art devices limit the lateral movement of head of the user, so that if the user is a contact sports player, and the jaw, not just the chin, is restrained from movement, the player is less likely to spot a player rapidly approaching, and cannot move away or brace himself or herself upon contact from the opposing player.

OBJECTS OF THE INVENTION

It is therefore an object of the present invention to provide a head and neck orientation support retainer, resting under the chin of a child or adult sports player. The retainer is a protruding wedge block placed to just be under the central chin of the player, which would appear to allow the player to have a wider freedom of side to side lateral movement, than if the entire jaw was retrained from ear to ear while the player's head is maintained horizontally for line of sight viewing purposes.

"Keep a player's head up" is a constant mantra in ice hockey. The meaning is not only to be able to develop skill but to have a vision on the ice that will help players avoid collisions.

Therefore, another object of the present invention is to provide a training device that will teach a young sports player how to feel the puck with their hands and not to look for it with their eyes, allowing them to see where teammates and opponents are at all times. The training device is also applicable for training adult sports players.

With all the focus on player safety, the present invention has the goal of helping players avoid dangerous collisions, whether by legal checks or accidental hits, while becoming a better overall player.

The head orientation retainer can be used while practicing at home and on the ice and will help young sports players further their hockey IQ by constantly seeing the game while enhancing their stick handling, passing and shooting skills.

The product is designed for child or adult athletes to train for their sport while keeping their head up to provide a safer way to play and also to enhance their skill and vision of the game. It can be worn during practices with the team and if one chooses, to practice at home.

It is yet another object of the present invention to improve over the disadvantages of the prior art.

Other objects which become apparent from the following description of the present invention.

SUMMARY OF THE INVENTION

The present invention is a Head and Neck Orientation Guard for children or adults playing contact sports where they look down instinctively, such as in ice hockey or roller hockey where they try and see the puck near their feet, or a soccer ball near their feet.

The problem is that in doing so, the child or adult is distracted from other players and the head in a precarious position of flexion. As a result, the child or adult cannot glance to the side or ahead to note opposing players moving excessively fast towards them because their head is oriented looking down, not horizontally forward or horizontally; lateral to either side.

Thus, when struck by another player (or by a flailing hockey stick) the child or adult has no time to brace him or herself. As a result, there is an overabundance of concussions and cervical neck whiplash injuries, which are exacerbated by the flexing downward of the head as the eyes are scouring the playing field, such as the ice hockey ice surface, the roller hockey indoor flooring or outdoor turf, the soccer field or the basketball court beneath the child's or adult's feet.

To solve that problem, the present invention is a head and neck orientation retainer including a protrusion wedge block which, attached to a mandatory soft cervical neck collar that young hockey players are required to wear, rests underneath the child's chin, in front of (and protecting) the "Adam's Apple" portion of the child's throat. The head and neck orientation retainer is also useful for adolescents or adults to wear while training to move a playing piece, such as an ice hockey puck, a roller hockey puck or ball, a field hockey ball, a soccer ball or a basketball.

While sizes may vary, for a child, preferably the wedge block is approximately three inches in height and an inch in front to back thickness. The top is about an inch and a half, and comprises a sloping, slightly curved at the edges, forward face panel, that the child rests his or her chin on. The lower portion is also sloped but slopes rearwardly and upward, to provide a slanted channel against which the top peripheral edge of the ice hockey player's chest protector abuts. For an older adolescent or adult, the sizes and geometric shapes may vary proportionately to accommodate large necks and chins.

Because of the two sloping top and bottom surfaces, in a side elevation view, the protruding wedge block preferably appears to be in the shape of a parallelogram, slightly rounded on the top, upon which the child's or adult's chin rests, where the front and rear surfaces of the wedge block are parallel to each other, and the top and bottom surfaces are sloped in a parallel fashion. For example, the top surface is sloped down from rear to front, so that the youth sports player's chin, or adult player's chin, comfortably rests thereon, and is supported to keep the head of the player in a horizontal, forward facing orientation. Likewise the bottom surface of the protruding wedge block slopes upward from front to back, to provide a concavity of generally triangular cross sectional configuration, so that, if the child sports player or adult sports player is wearing a typical chest protector, the top edge of the chest protector is inserted within the triangular concavity formed by the sloping bottom surface of the protruding wedge block, and the upright chest region of the child or adult player. However, other geometric shapes may be used instead of the parallelogram. For example, the wedge block could be rectangular in cross section, or ovoid, or other three-dimensional shape with straight, slanted or curved surfaces, which may be smooth or textured, such as egg crate-shaped for comfort, like cushions or mattresses. The important point is that the geometric-shaped block is only under the chin, not the entire jaw, so that lateral movement is not impeded.

The protruding wedge block holds the child's or adult's head in a generally horizontal orientation, so that the child or adult can see any advancing players, and can also see a puck, a ball, a basketball or soccer ball's position approximately six feet or more ahead of where the child or adult is advancing from.

While holding the head up horizontally, the device helps reduce the impact of violently contacting players or hockey sticks against the child or adult player, enabling the child or adult to brace before impact or preferably to make an evasive move away from the advancing opponent player. The head and neck orientation guard device is also a training device, because the child or adult learns how to feel the puck by the tactile touch of the puck against the child's hockey stick, through the vibrations of the hockey stick being held in the child's or adult's hands. That enables the child or adult to learn how to control the movement of the hockey puck towards the goal on the ice playing surface, or on a dry roller hockey playing surface, without needing to look down directly at the puck.

To a lesser extent, the child playing soccer, basketball or field hockey can learn how to "dribble" the soccer ball with the child's feet, or the basketball with the user's hands, or to advance a field hockey ball without having to look down in an undesirable "looking down" flexion orientation of the child's or adult's head.

Without being limited to any sport, the training device can be used in any other individual or multiple player team sport, such as speed ice skating, speed roller skating, baseball, softball, archery, golf, polo, track and field, running cross country, tennis, squash, hand ball, volleyball, badminton, ping pong, bowling, gymnastics, ballet, competitive dancing, karate, judo, jiu jitsu, boxing, martial arts, wrestling, rock climbing, cricket or other ethnic player team sports. It can also be a training device where head gear helmets are used, such as in football or lacrosse. It is also applicable to winter sports including, but not limited to, figure ice skating, skiing, snowboarding, ski jumping, tobogganing, or other outdoor spots, such as bicycle riding, rodeo animal riding, horseback riding, ATV riding, skateboarding, sail boating, motor boating or rowing crew boating.

The protruding wedge block is made of a comfortable but denser foam than that of the cervical neck collar to which it attaches by sewing within an integral fabric sleeve or otherwise fastened thereto.

The fabric cover can be made of fabric such as cotton, polyester, nylon or denim, or from special perspiration wicking fabrics, such as microfiber fabric made of ultrafine synthetic fibers which are soft, stretchy and stain resistant and which wick away moisture. The fabric cover can also be preferably made of other liquid resistant fabrics, such as sport nylon and other flexible fabrics, such as tear resistant ripstop nylon.

BRIEF DESCRIPTION OF THE DRAWINGS

The present invention can best be understood in connection with the accompanying drawings. It is noted that the invention is not limited to the precise embodiments shown in drawings, in which:

FIG. 6 is a side view of the wedge block;

FIG. 7 is a front view of the wedge block;

FIG. 8 is a top plan view of the wedge block;

DETAILED DESCRIPTION OF THE INVENTION

Figure 1:
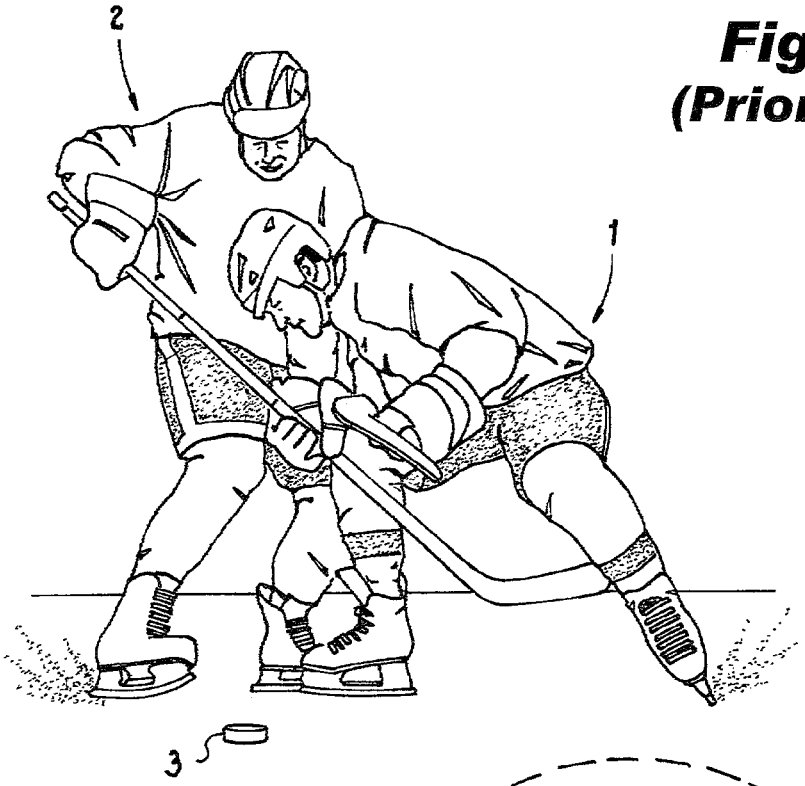
Fig. 1 (Prior Art)
FIG. 1 is a perspective prior art view of two youth hockey players colliding.
Figure 2:
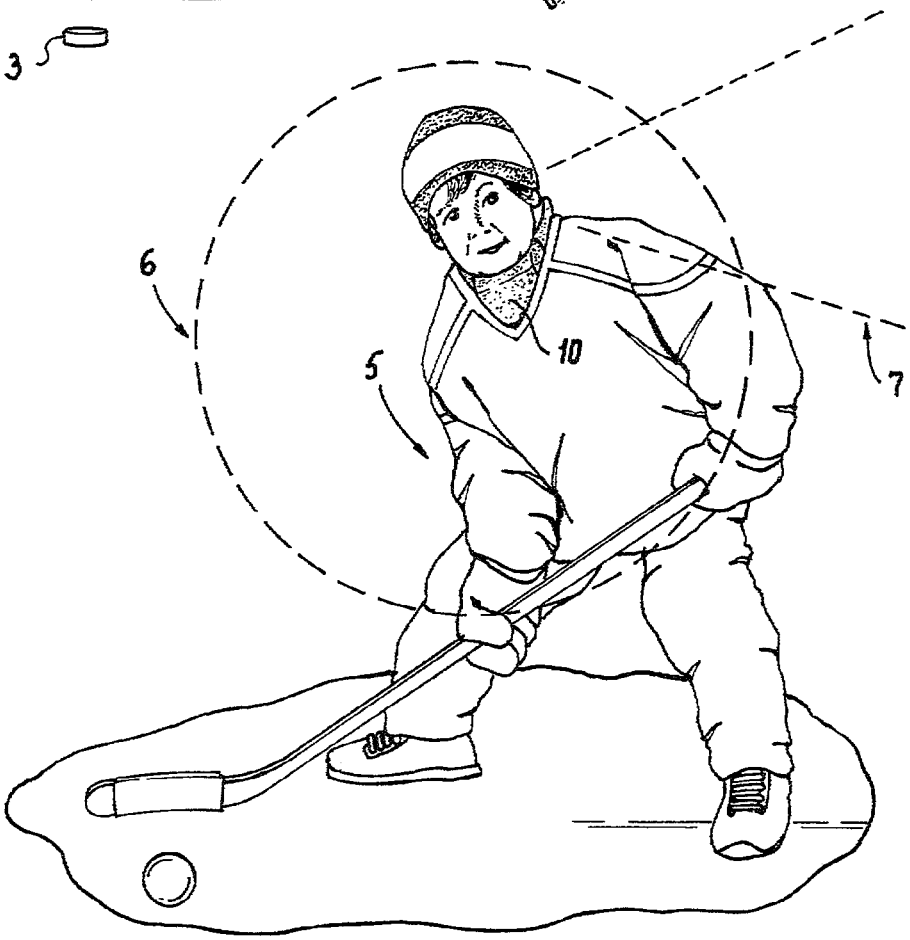
FIG. 2 is a perspective view of a youth hockey player skating with the puck, showing his forward and lateral fields of vision due to the wedge block orienting the head of the youth hockey player in a generally horizontal orientation.

Prior art FIG. 1 represents a situation which should become less common as the head and neck orientation retainer of this invention is adopted for child or adult sports activities. Player 2 is shown crashing into player 1 on hockey ice, as player 1 seems to have his eyes and head down following the puck 3. Injuries could follow. In contrast, FIG. 2 shows player 5 in a practice session holding his head up. In this orientation, his forward cone of vision is outlined as reference numeral 6 for the nearby vicinity. By slightly turning his head, his vision would shift laterally to the cone of vision outlined by the two dashed lines 7. The wedge block of the present invention helps a player 5 hold his head up as shown.

Figure 5:
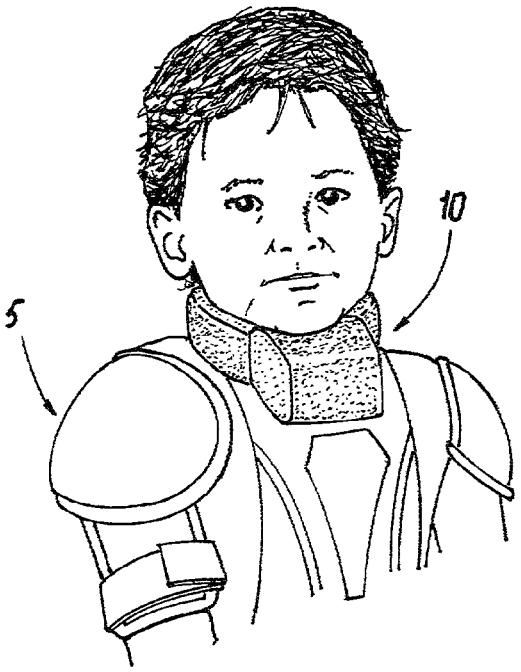
FIG. 5 is an enlarged close-up detail view of the upper corner of the wedge block, with the cover ripped away to reveal the foam.
Figure 3:
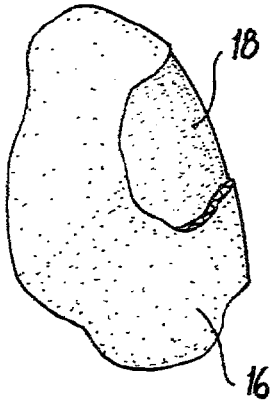
FIG. 3 is a perspective close-up view of a youth hockey player wearing the wedge block.
Figure 4:
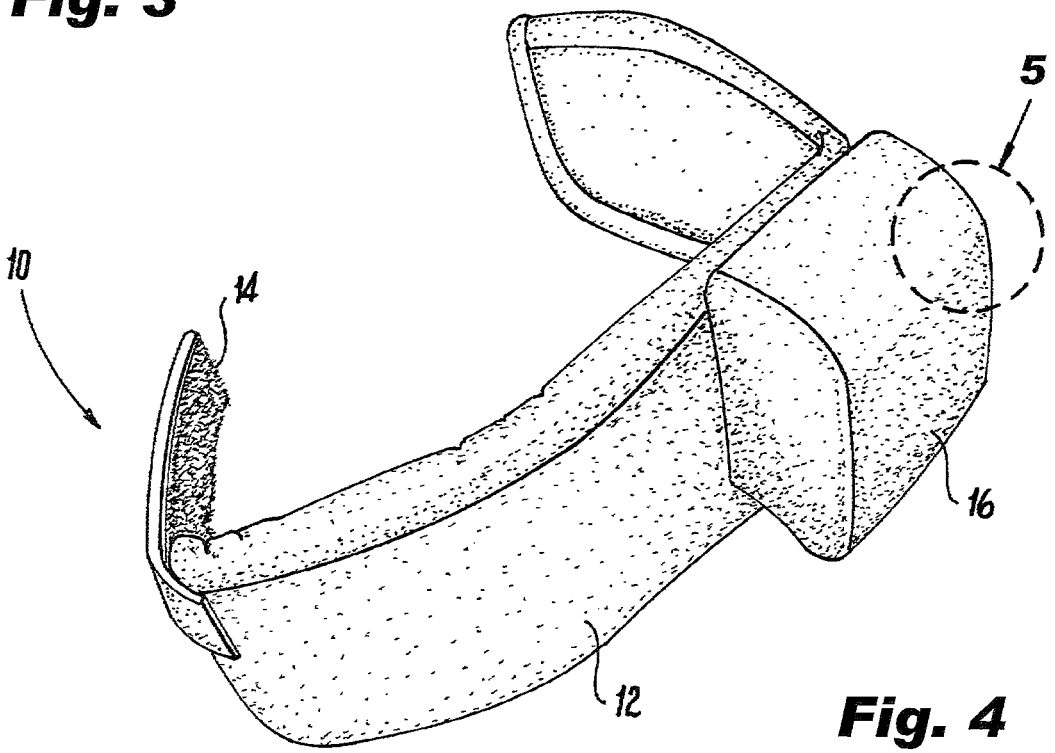
FIG. 4 is a perspective view of the wedge block and collar strap.

In FIG. 3 there is shown a seated player 5 clearly donning head orientation wedge block and collar retainer 10 of this invention. The details of the head orientation retainer 10 are illustrated in FIGS. 4-8. FIG. 4 shows the parts of retainer 10 as attached in a completed unit with wedge block 16 attached to neck encircling strap or cervical collar 12. The strap or cervical collar 12 is shown with VELCRO® adjustable locking strip 14. Head adjusting wedge block 16 is attached to front of strap or cervical collar 12. FIG. 5 is a close-up detail view showing the stiffer foam core 18 of wedge block 16 with a fabric covering.

While other geometric shapes may be employed, FIG. 6 is a side view close-up of wedge block 16 showing the preferably roughly parallelogram shape, which makes the player 5's chin contact at the top surface thereof, while fitting to the top of a hockey chest protector (if present). FIG. 7 is a front view of the wedge block 16, shown attached to a front portion of strap or cervical collar 12, and FIG. 8 is a top plan view of the wedge block 16, also shown attached to a front portion of strap or cervical collar 12.

Figure 9:
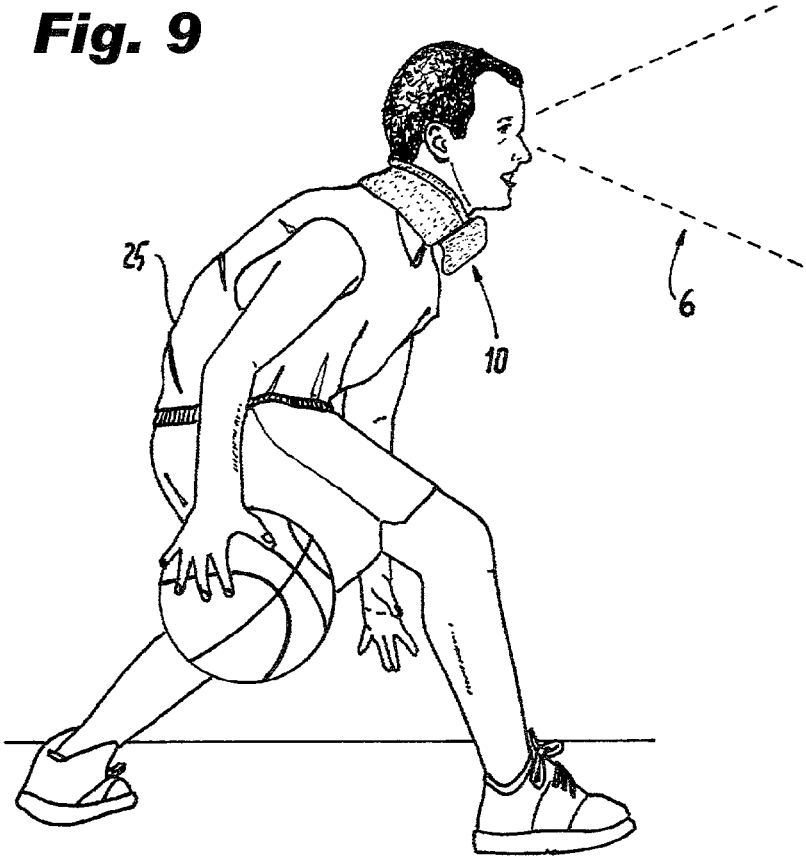
FIG. 9 is a perspective view of a youth or adolescent basketball player dribbling while wearing the wedge block; showing his forward field of vision due to the wedge block orienting the head of the youth basketball player in a generally horizontal orientation.

FIG. 9 shows a boy basketball player 25 donning head orientation retainer 10 with wedge block 16 of this invention. It is noted that that he is dribbling a basketball with his hands, while looking forward according to forward cone of vision 6.

Figure 10:
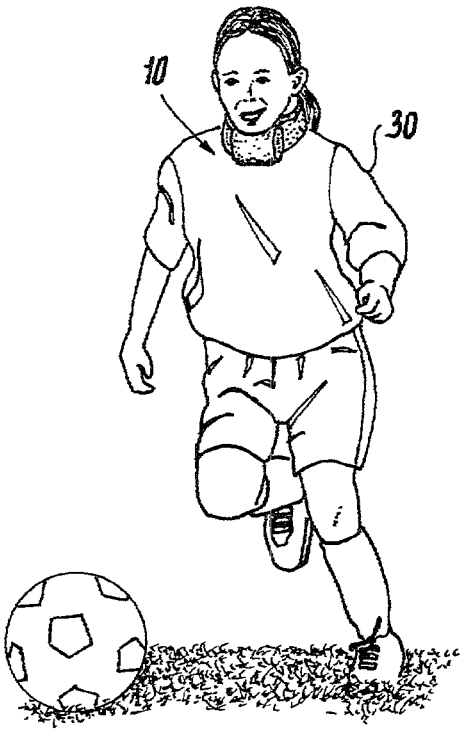
FIG. 10 is a perspective view like FIG. 9, but showing a youth soccer player dribbling a soccer ball with her feet, while the youth soccer player wears the wedge block under her chin.

FIG. 10 shows a girl soccer player 30 donning retainer 10 with wedge block 16 holding her head up while controlling the soccer ball with her feet.

Figure 11:
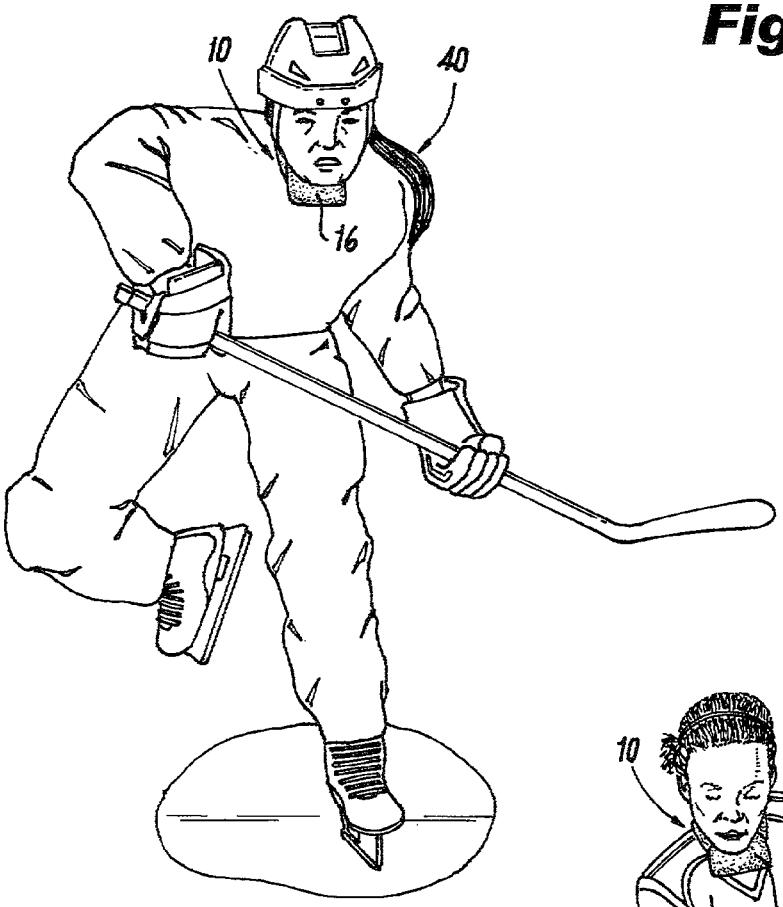
FIG. 11 is a perspective view of an adolescent or adult ice hockey player, training for playing ice hockey.

FIG. 11 shows an adult hockey player 40, wearing retainer 10 with wedge block 16, while training or playing ice hockey.

Figure 12:
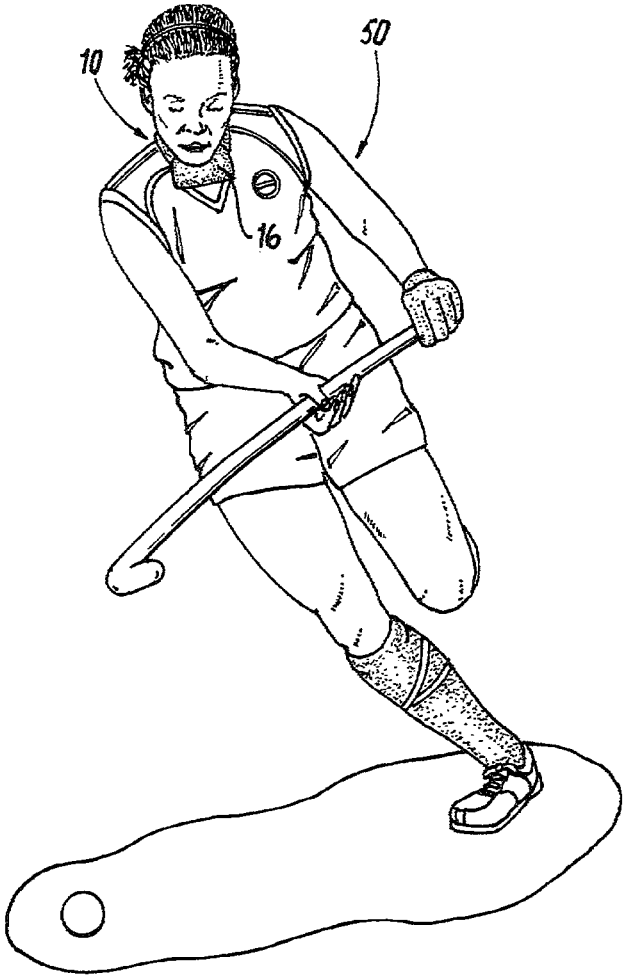
FIG. 12 is a perspective view of a female high school athlete, training for playing field hockey.

FIG. 12 shows a female high school athlete 50, wearing retainer 10 with wedge block 16, while training or playing field hockey.

Figure 13:
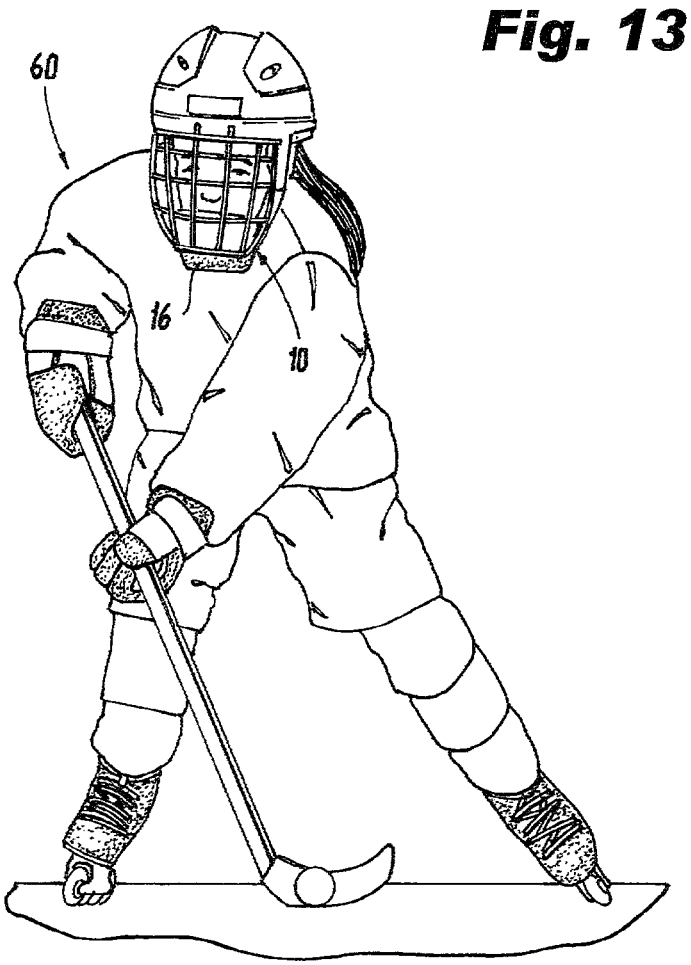
FIG. 13 is a perspective view of a young female roller hockey player on skates.

FIG. 13 shows a young female roller hockey player 60, with protective gear and moving on skates, wearing retainer 10 with wedge block 16, while training or playing roller hockey.

It is further noted that other variations of the head orientation retainer of the present invention may be disclosed, within the scope of the above noted description thereof.

We claim:

1. A sports head and neck retainer and training device comprising:

a cervical collar having an adjustable locking strip along a rear portion thereof; and, a head adjusting protruding wedge block mounted on a front of said cervical collar located and shaped to contact and support a chin of a user for holding the user's head up for viewing forward horizontally while allowing lateral movement of the head of the user;

whereby said protruding wedge block extends outward from said front of said cervical collar with an upper surface thereof of said wedge block adapted to contact said chin of said user.

2. A sports head and neck retainer and training device comprising:

a cervical collar having an adjustable locking strip along a rear portion thereof; and a head adjusting protruding wedge block mounted on a front of said cervical collar located and shaped to contact and support a chin of a user for holding the user's head up while allowing lateral movement of the head of the user;

in which said protruding wedge block has a rear surface attached to said cervical collar extending above a top edge of said cervical collar, a downwardly directed flat surface extending from a top edge of said rear surface for providing a resting place and support of the user's chin, said downwardly directed flat surface curving to form a front surface of said protruding wedge block.

3. The device of claim 2 in which said protruding wedge block comprises a stiff foam core with a fabric covering.

4. The device of claim 3 in which said protruding wedge block has a pair of flat oppositely facing sides.

5. The device of claim 4 in which a side cross section of said protruding wedge block is in the shape of a parallelogram, wherein at least two of the parallel sides are slanted.

6. The device of claim 5 wherein said protruding wedge block is rounded on the top, upon which the player's chin rests, wherein further, the front and rear surfaces of said protruding wedge block are parallel to each other, and the top and bottom surfaces are sloped in a parallel fashion.

7. The device of claim 6 further comprising said top surface of said protruding wedge block is sloped down from rear to front, so that the sports player's chin comfortably rests thereon, and is supported to keep the head of the player in a horizontal, forward facing orientation.

8. The device of claim 7 wherein a bottom surface of said protruding wedge block slopes upward from front to back, to provide a concavity of generally triangular cross sectional configuration, wherein, if the sports player is wearing a chest protector, a top edge of the chest protector is inserted within the triangular concavity formed by the sloping bottom surface of said protruding wedge block, and the upright chest region of the player.

9. The device of claim 1 wherein said protruding wedge block is rectangular in cross section.

10. The device of claim 1 wherein said protruding wedge block is ovoid in cross section.

11. A method of training a player to hold his or her head upright while engaged in a sports activity comprising the steps of:

installing a cervical collar on said player, said collar having an adjustable locking strip along a rear portion thereof; and mounting a protruding wedge block on a front of said cervical collar to support the chin of said player for holding the player's head up for viewing forward horizontally while allowing lateral movement of the head;

whereby said protruding wedge block extends outward from said front of said cervical collar with an upper surface thereof of said wedge block adapted to contact said chin of said user.

12. A method of training a player to hold his or her head upright while engaged in a sports activity comprising the steps of:

installing a cervical collar on said player, said collar having an adjustable locking strip along a rear portion thereof; and mounting a protruding wedge block on a front of said cervical collar to support the chin of said player for holding the player's head up while allowing lateral movement of the head;

in which said protruding wedge block has a rear surface attached to said cervical collar extending above a top edge of said cervical collar, a downwardly directed flat surface extending from a top edge of said rear surface for providing a resting place and support of the player's chin, said downwardly directed flat surface curving to form a front surface of said protruding wedge block.

13. The method of claim 12 in which said protruding wedge block comprises a stiff foam core with a fabric covering.

14. The method of claim 13 in which said protruding wedge block has a pair of flat oppositely facing sides.

15. The method of claim 12 in which a side cross section of said protruding wedge block is in the shape of a parallelogram, wherein at least two of the parallel sides are slanted.

16. The method of claim 11 in which a side cross section of said protruding wedge block is in the shape of a rectangle.

17. The method of claim 11 in which a side cross section of said protruding wedge block is in the shape of an ovoid.

18. The method of claim 12 in which the sports activity being engaged in is ice hockey.

19. The method of claim 12 in which the sports activity being engaged in is basketball.

20. The method of claim 12 in which the sports activity being engaged in is soccer.

21. The method of claim 12 in which the sports activity being engaged in is field hockey.

22. The method of claim 12 in which the sports activity being engaged in is roller hockey.

23. The method of claim 12 in which the sports activity being engaged in is selected from the group consisting of ice hockey, field hockey, roller hockey, speed ice skating, speed roller skating, basketball, soccer, baseball, softball, archery, golf, polo, track and field, running cross country, tennis, squash, hand ball, volleyball, badminton, ping pong, bowling, gymnastics, ballet, competitive dancing, karate, judo, jiu jitsu, boxing, martial arts, wrestling, cricket, ethnic player team sports, football, lacrosse, figure ice skating, skiing, snowboarding, ski jumping, tobogganing, outdoor bicycle riding, rodeo animal riding, horseback riding, ATV riding, skateboarding sail boating, motor boating or rowing crew boating.

24. The device of claim 1 in which said protruding wedge block comprises a stiff foam core with a fabric covering.

25. The method of claim 11 in which said protruding wedge block comprises a stiff foam core with a fabric covering.

* * * * *